US008044920B2

(12) United States Patent
Liao et al.

(10) Patent No.: US 8,044,920 B2
(45) Date of Patent: Oct. 25, 2011

(54) BACKLIGHT CONTROL CIRCUIT WITH LOW BRIGHTNESS VARIATION WHEN LIGHT EMITTING DEVICES NOT OPERATING

(75) Inventors: Chiawei Liao, San Jose, CA (US); Jing-Meng Liu, Jubei (TW)

(73) Assignee: Richtek Technology Corporation, Hsin-Chu (TW)

( * ) Notice: Subject to any disclaimer, the term of this patent is extended or adjusted under 35 U.S.C. 154(b) by 867 days.

(21) Appl. No.: 11/906,511

(22) Filed: Oct. 2, 2007

(65) Prior Publication Data

US 2008/0094007 A1 Apr. 24, 2008

(30) Foreign Application Priority Data

Oct. 19, 2006 (TW) ..... 95138637 A

(51) Int. Cl.
*G09G 3/36* (2006.01)

(52) U.S. Cl. ..... 345/102; 345/76; 345/77; 345/82; 349/69

(58) Field of Classification Search ..... 345/76–82, 345/204–215, 690–699
See application file for complete search history.

(56) References Cited

U.S. PATENT DOCUMENTS

| | | | | |
|---|---|---|---|---|
| 5,714,968 | A * | 2/1998 | Ikeda | 345/76 |
| 6,288,497 | B1 | 9/2001 | Chang et al. | |
| 6,515,642 | B1 * | 2/2003 | Lin | 345/87 |
| 6,686,898 | B2 * | 2/2004 | Chen et al. | 345/82 |
| 2003/0011625 | A1 * | 1/2003 | Kellis | 345/690 |
| 2004/0233144 | A1 * | 11/2004 | Rader et al. | 345/82 |
| 2005/0057580 | A1 * | 3/2005 | Yamano et al. | 345/690 |
| 2005/0104542 | A1 * | 5/2005 | Ito et al. | 315/291 |
| 2005/0231459 | A1 * | 10/2005 | Furukawa | 345/102 |
| 2007/0008253 | A1 * | 1/2007 | Nathan et al. | 345/76 |
| 2007/0091036 | A1 * | 4/2007 | Han et al. | 345/82 |
| 2007/0273681 | A1 * | 11/2007 | Mayell | 345/211 |
| 2007/0291198 | A1 * | 12/2007 | Shen | 349/69 |
| 2008/0048737 | A1 * | 2/2008 | Ito et al. | 345/204 |

FOREIGN PATENT DOCUMENTS

| | | | |
|---|---|---|---|
| JP | 2002-141186 | A | 5/2002 |
| WO | WO 01/73735 | A2 | 10/2001 |
| WO | WO 2006059438 | A1 * | 6/2006 |

* cited by examiner

*Primary Examiner* — Bipin Shalwala
*Assistant Examiner* — Ryan A Lubit
(74) *Attorney, Agent, or Firm* — Tung & Associates

(57) ABSTRACT

The present invention discloses a backlight control circuit, and a method for controlling light emission devices. The method comprises: providing a plurality of light emission device paths connected in parallel; and setting a total current of the paths connected in parallel to a constant.

23 Claims, 17 Drawing Sheets

BACKLIGHT CONTROL CIRCUIT WITH LOW BRIGHTNESS VARIATION WHEN LIGHT EMITTING DEVICES NOT OPERATING

FIELD OF INVENTION

The present invention relates to a backlight control circuit, more particularly, to a backlight control circuit with low backlight brightness variation when some of the light emitting diodes (LEDs) do not properly operate.

BACKGROUND OF THE INVENTION

In a liquid crystal display (LCD), a backlight control circuit is used which controls LEDs to illuminate from the back side of an LCD screen, so that a user can observe an image from the front side of the LCD screen.

In early days, LED backlight is used only in a small size screen, which does not require high backlight brightness. Therefore, the LEDs can be connected all in series or all in parallel. FIG. 1 shows a prior art circuit wherein all LEDs are connected in series. As shown in the figure, a backlight control circuit 10 comprises a voltage supply circuit 11 converting an input voltage Vin to an output voltage Vout which is supplied to a plurality of LEDs L1-LN connected in series. A resistor R is provided on a path of the LEDs connected in series, and a voltage at a node Vsense1 is compared with a reference voltage Vref to check whether a current through the path satisfies a predetermined condition. If the current is lower than a predetermined value and the voltage at the node Vsense1 decreases, an error amplifier circuit 13 sends a signal 15 to the voltage supply circuit 11 to pull up the output voltage Vout, so that the current flowing through the LEDs increases. Moreover, to prevent the voltage supply circuit 11 from unlimitedly increasing the output voltage Vout (for example, when the error amplifier circuit 13 malfunctions, or when the path of the LEDs is open), an over voltage protection circuit 12 is provided in the backlight control circuit 10, which detects the output voltage Vout and sends a signal to stop the voltage supply circuit 11 from increasing the output voltage Vout if the output voltage Vout is excessively high. (Depending on circuit design, the voltage supply can be totally stopped, or kept at an upper limit value. The latter is more popular in a backlight control circuit.)

FIG. 2 shows a typical structure of an over voltage protection circuit 12, wherein the output voltage Vout is monitored by comparing the voltage at the node Vsense2 with a reference voltage Vovp. The result of comparison determines a signal for controlling the voltage supply circuit 11.

The above arrangement wherein all LEDs are connected in series has several drawbacks. An obvious drawback is that, due to series connection, if one LED shuts down, all the other LEDs are shut down; the LCD will be in complete darkness.

Referring to FIG. 3, it shows a conventional backlight control circuit with LEDs all connected in parallel. As shown in the figure, in a backlight control circuit 20, the currents passing through LEDs L1-LN are respectively controlled by the current sources CS1-CSN. The backlight control circuit 20 comprises a lowest voltage selection circuit 21 (Lowest V. Sel. Ckt.) which chooses a lowest voltage value among all voltages at cathode ends of the LEDs L1-LN, and the error amplifier circuit 13 compares the lowest voltage value with a reference voltage to generate a signal controlling the voltage supply circuit 11. Thus, the output voltage Vout is under control so that all current source circuits are provided with sufficient operating voltage for normal operation, and all LEDs can illuminate normally thereby.

Similarly, the backlight control circuit 20 can further comprise an over voltage protection circuit 12 as the one described above.

In the arrangement where all LEDs are connected in parallel, although an over voltage protection circuit or other means can be employed (for example the under current detection circuits as described in a co-pending patent application filed by the same assignee on the same filing date under the same title) to prevent the overall circuit from completely shut down because of one or a few inoperative LEDs, the overall brightness of the LCD still drops. Besides, as the size of the LCD screen becomes larger which requires higher backlight brightness, a series-parallel connection circuit as shown in FIG. 4 is probably used to increase the number of LEDs to be connected. In this arrangement, if one of the LED paths is inoperative, the backlight brightness will drop more severely.

Thus, a backlight control circuit with low backlight brightness variation when some of the LEDs do not properly operate, is desired.

SUMMARY

In view of the foregoing, it is therefore an objective of the present invention to provide a backlight control circuit capable of automatically adjusting supply current to LEDs, to compensate the brightness variation.

It is another objective of the present invention to provide a backlight control method to solve the problems in prior art.

In accordance with the foregoing and other objectives, and from one aspect of the present invention, a backlight control circuit comprises: a plurality of current matching circuits respectively controlling currents on corresponding plurality of light emission device paths; and a common node electrically connected with the plurality of current matching circuits, for electrically connecting with a total current setting circuit.

The total current setting circuit described above can be a common resistor or a total control current source.

From another aspect of the present invention, a backlight control circuit comprises: a plurality of light emission device paths; and a common node electrically connected with the plurality of light emission device paths, and also electrically connected with a total control current source, the total control current source controlling a total current on the plurality of light emission device paths.

From a further aspect of the present invention, a method for controlling light emission devices comprises: providing a plurality of light emission device paths connected in parallel; and setting a total current of the paths connected in parallel to a constant.

The total current can be set by a common resistor or a total control current source.

Preferably, the brightness of each light emission device is set lower than a maximum brightness.

Also preferably, the light emission devices form an array, in which two neighboring light emission devices belong to two different light emission device paths.

These and other features, aspects, and advantages of the present invention will become better understood with reference to the following description of preferred embodiments and accompanying drawings.

DESCRIPTION OF THE PREFERRED EMBODIMENTS

Figure 1:
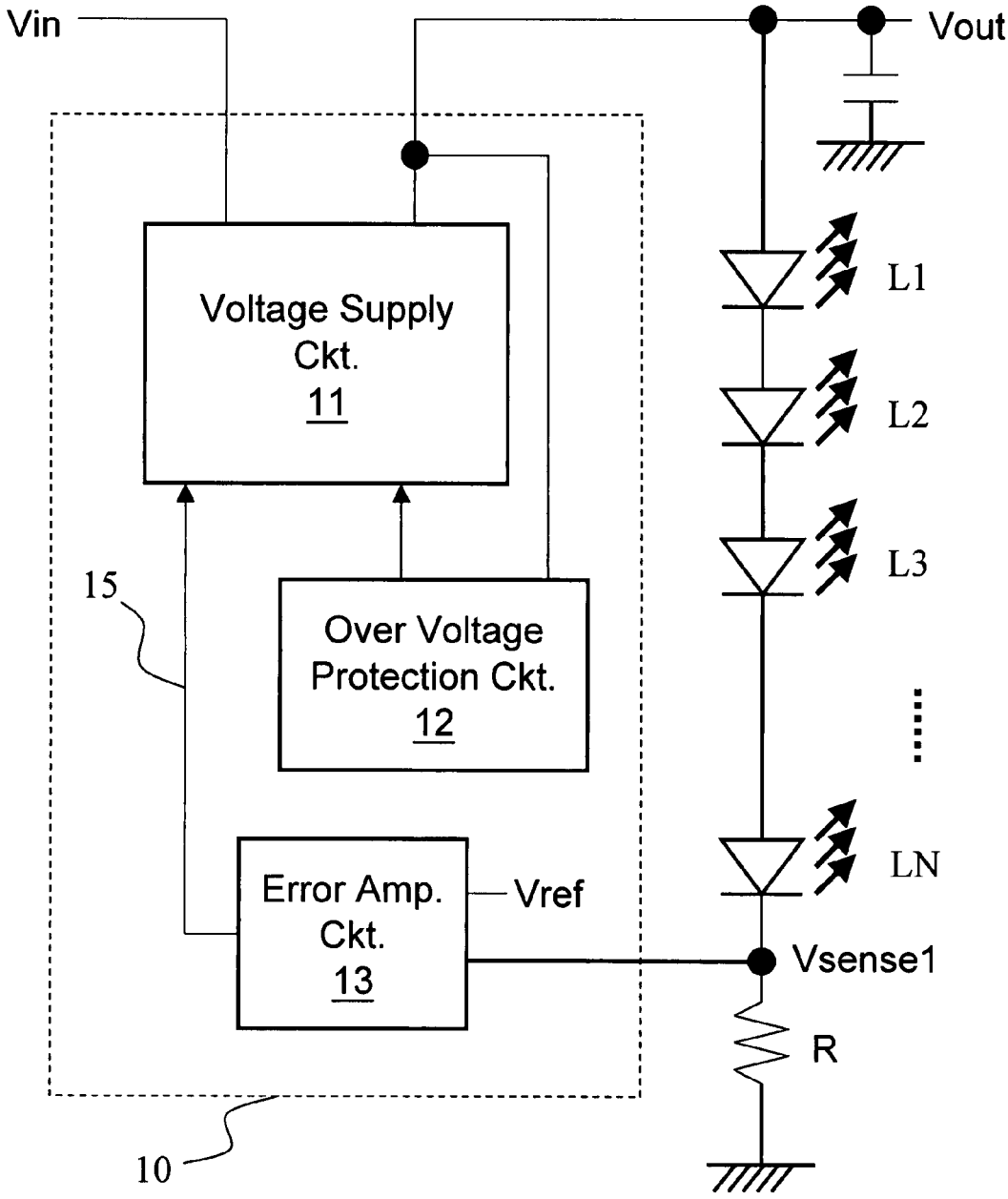
Fig. 1 (Prior Art)
FIG. 1 is a schematic circuit diagram showing a prior art circuit including LEDs which are all connected in series and a backlight control circuit thereof.
Figure 2:
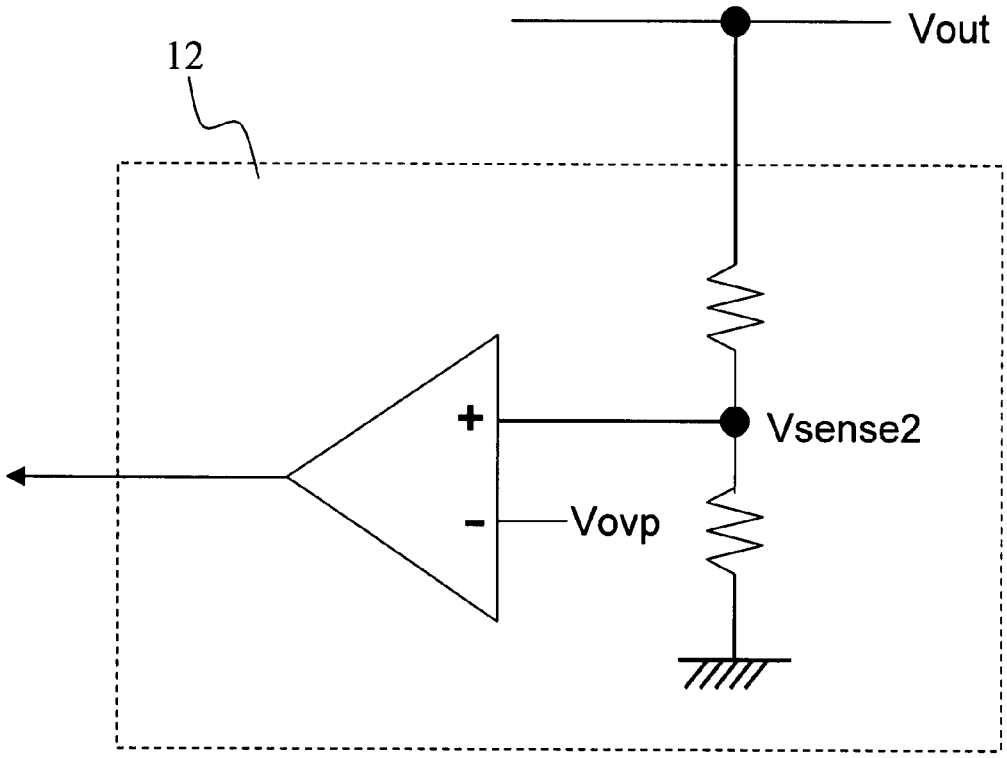
Fig. 2 (Prior Art)
FIG. 2 is a schematic circuit diagram showing a conventional over voltage protection circuit.
Figure 3:
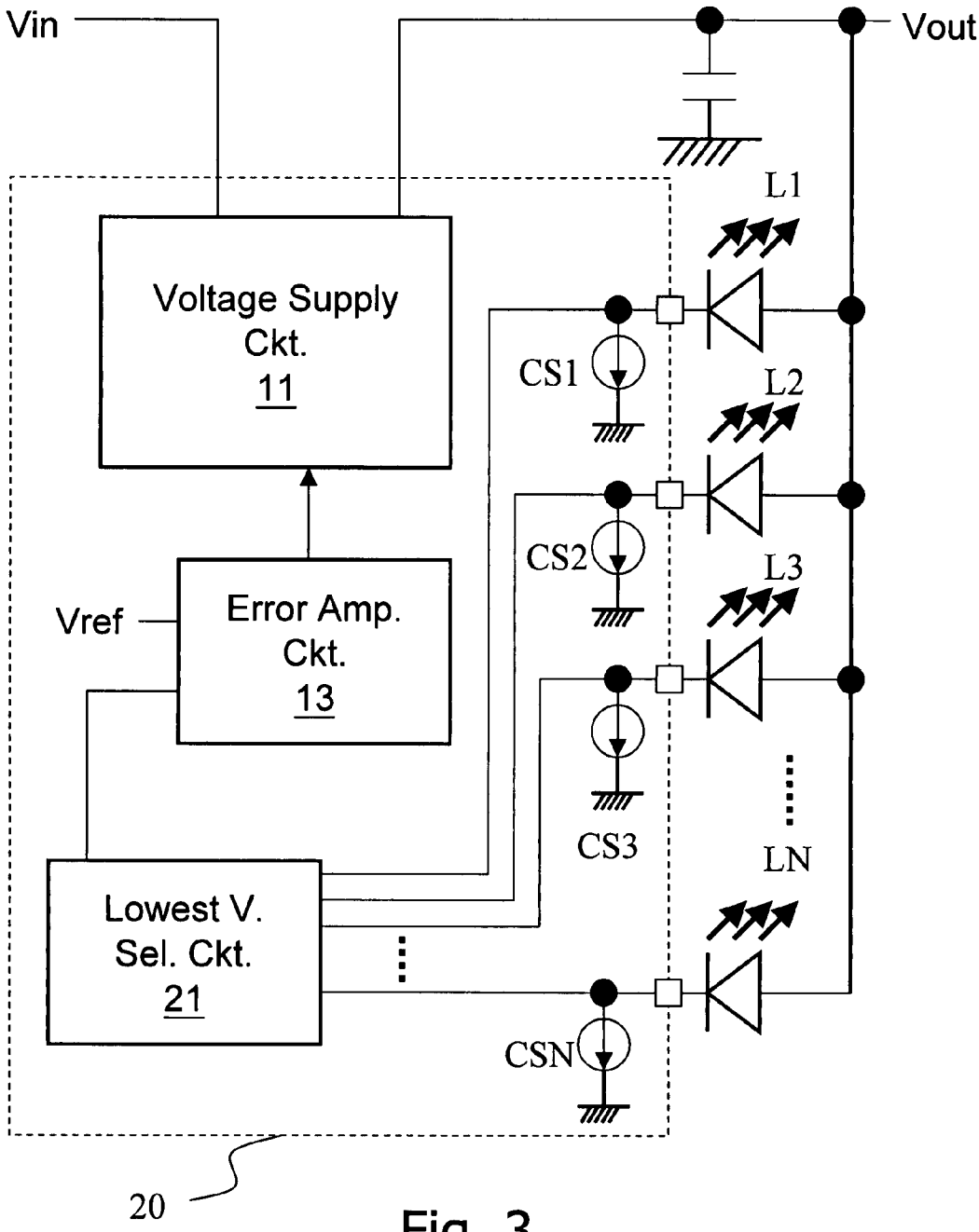
Fig. 3 (Prior Art)
FIG. 3 is a schematic circuit diagram showing a prior art circuit including LEDs which are all connected in parallel and a backlight control circuit thereof.
Figure 4:
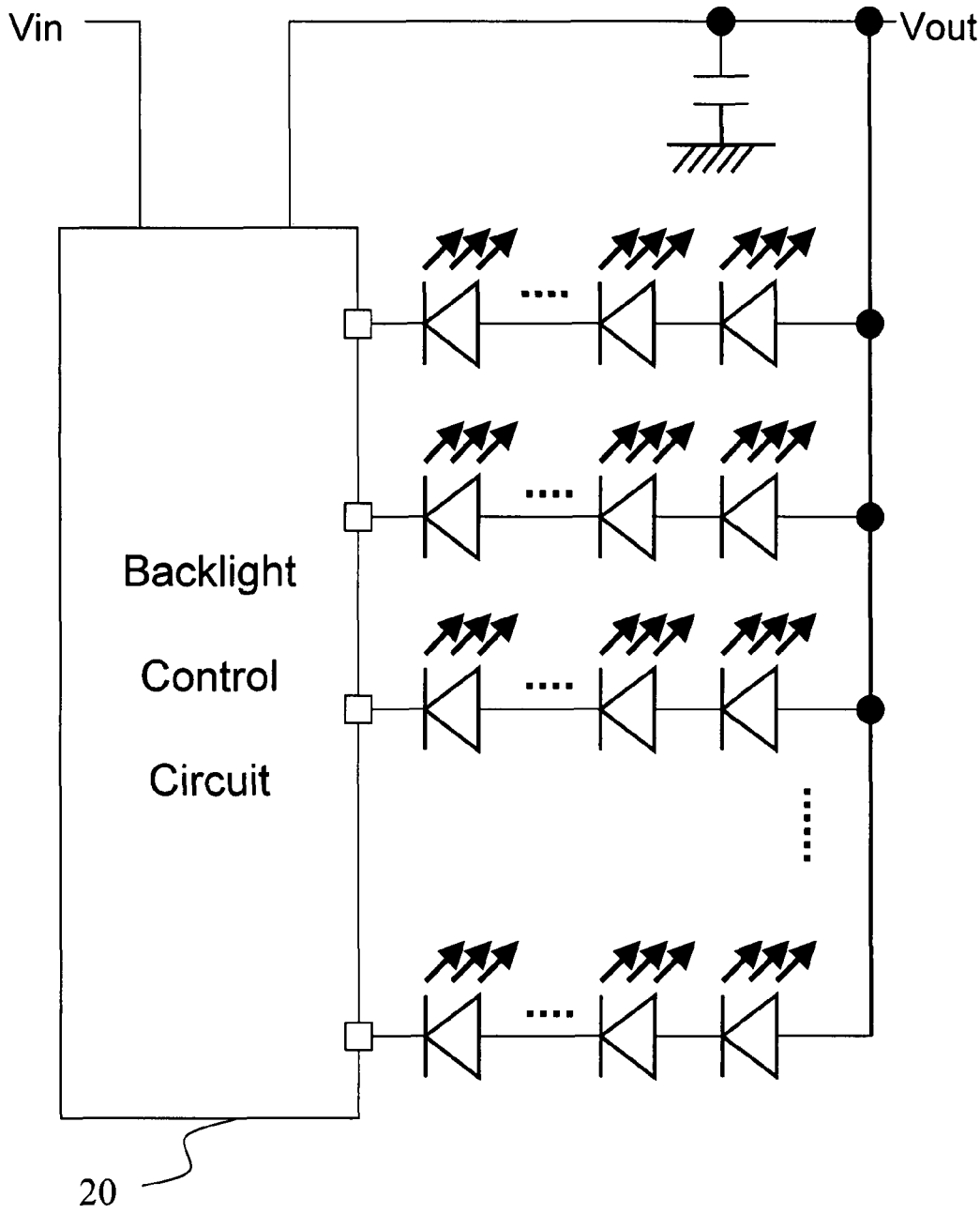
Fig. 4 (Prior Art)
FIG. 4 is a schematic circuit diagram showing a prior art circuit including LEDs in series-parallel connection, and a backlight control circuit thereof.
Figure 5:
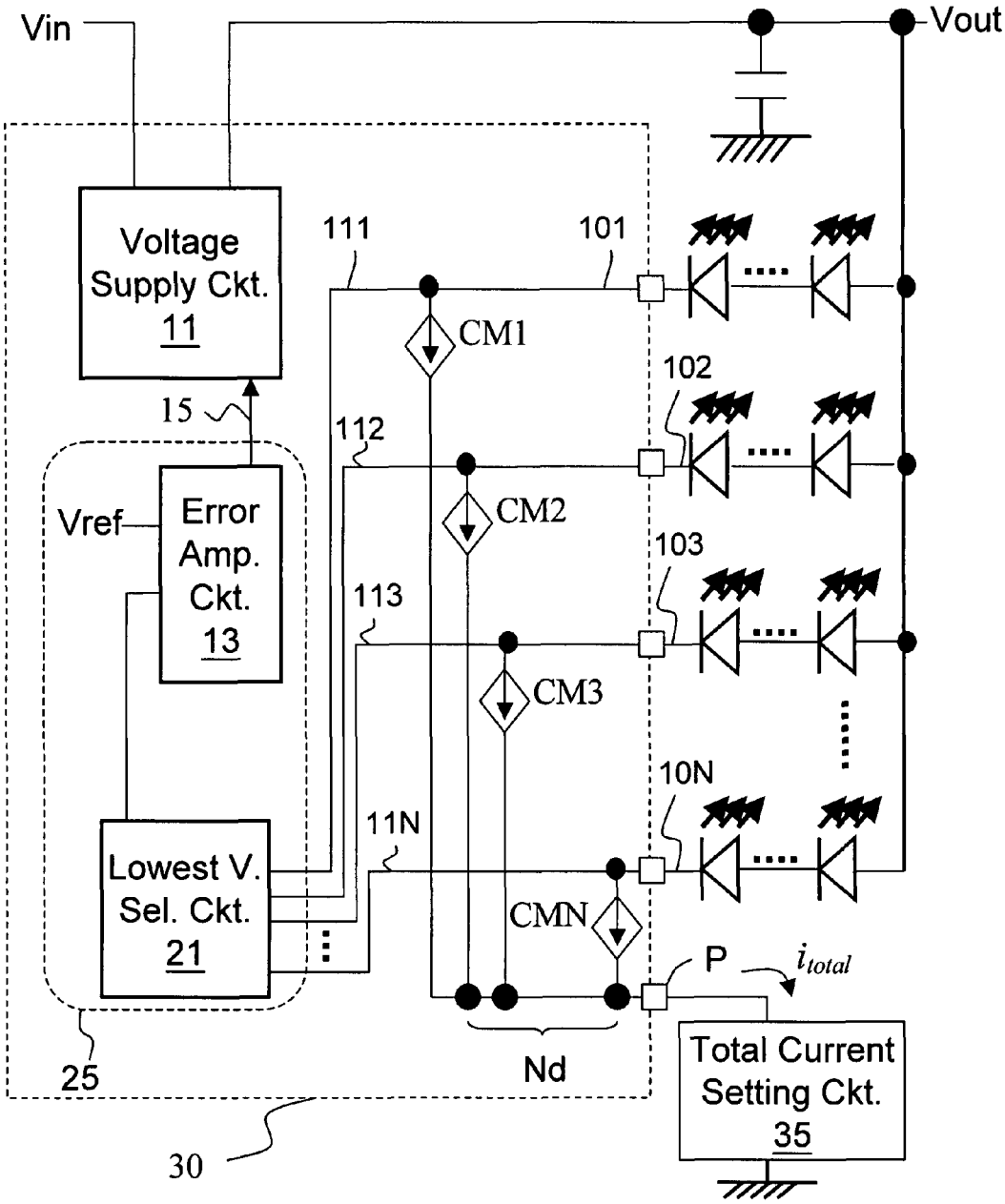
FIG. 5 is a schematic circuit diagram showing a backlight control circuit according to an embodiment of the present invention.

FIG. 5 is a schematic circuit diagram showing a backlight control circuit according to an embodiment of the present invention. As shown in the figure, the backlight control circuit 30 according to this embodiment comprises a plurality of current matching circuits CM1-CMN, whose function is to match the currents at their respective paths with one another. The term "to match currents" as used in this specification means "to keep the currents in a constant ratio", and in most cases the currents are kept the same or similar. Each of the current matching circuits CM1-CMN has a circuit structure very similar to that of a current source, but it is referred to as a "current matching circuit" in this specification because it can not actually decide the current amount in its path; it can only decide the ratio between paths. The current amount in each and all of the paths is primarily controlled by a total current setting circuit 35. As shown in the figure, the current matching circuits CM1-CMN are all connected to a common node Nd, which is connected to ground via the total current setting circuit 35. The total current setting circuit 35 serves to set the current $i_{total}$ and keeps it. If the backlight control circuit 30 is an integrated circuit, the total current setting circuit 35 can be located partially or all in the outside of the integrated circuit and connected with the integrated circuit through a pin P so that the current setting can be performed externally. Of course, if the current $i_{total}$ needs not be adjusted after setting, the total current setting circuit 35 can be located all inside the integrated circuit.

Figure 6:
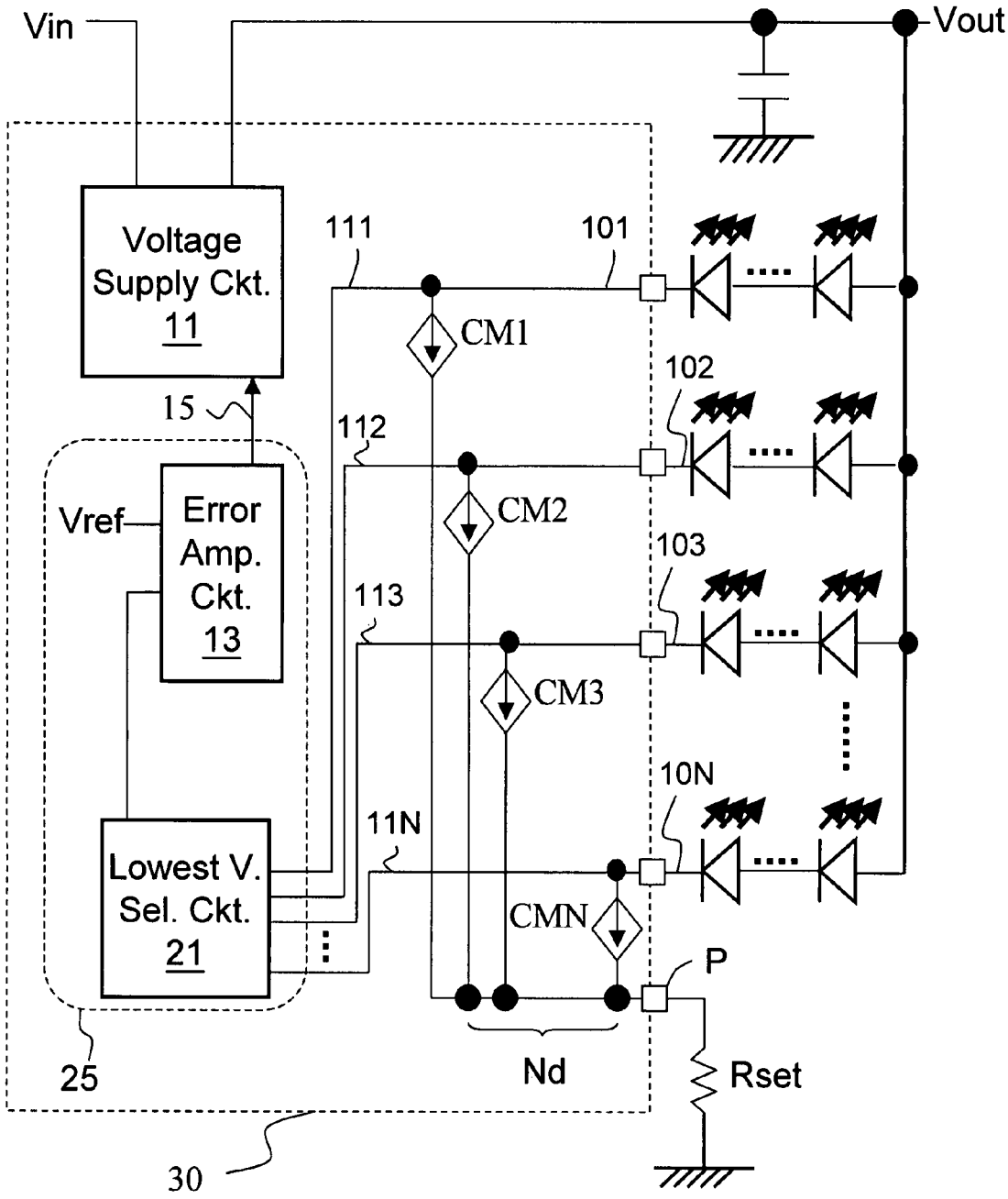
FIG. 6 is a schematic circuit diagram showing a backlight control circuit according to another embodiment of the present invention.

In one embodiment, the total current setting circuit 35 can simply be a common resistor Rset, as shown in FIG. 6.

Figure 7A:
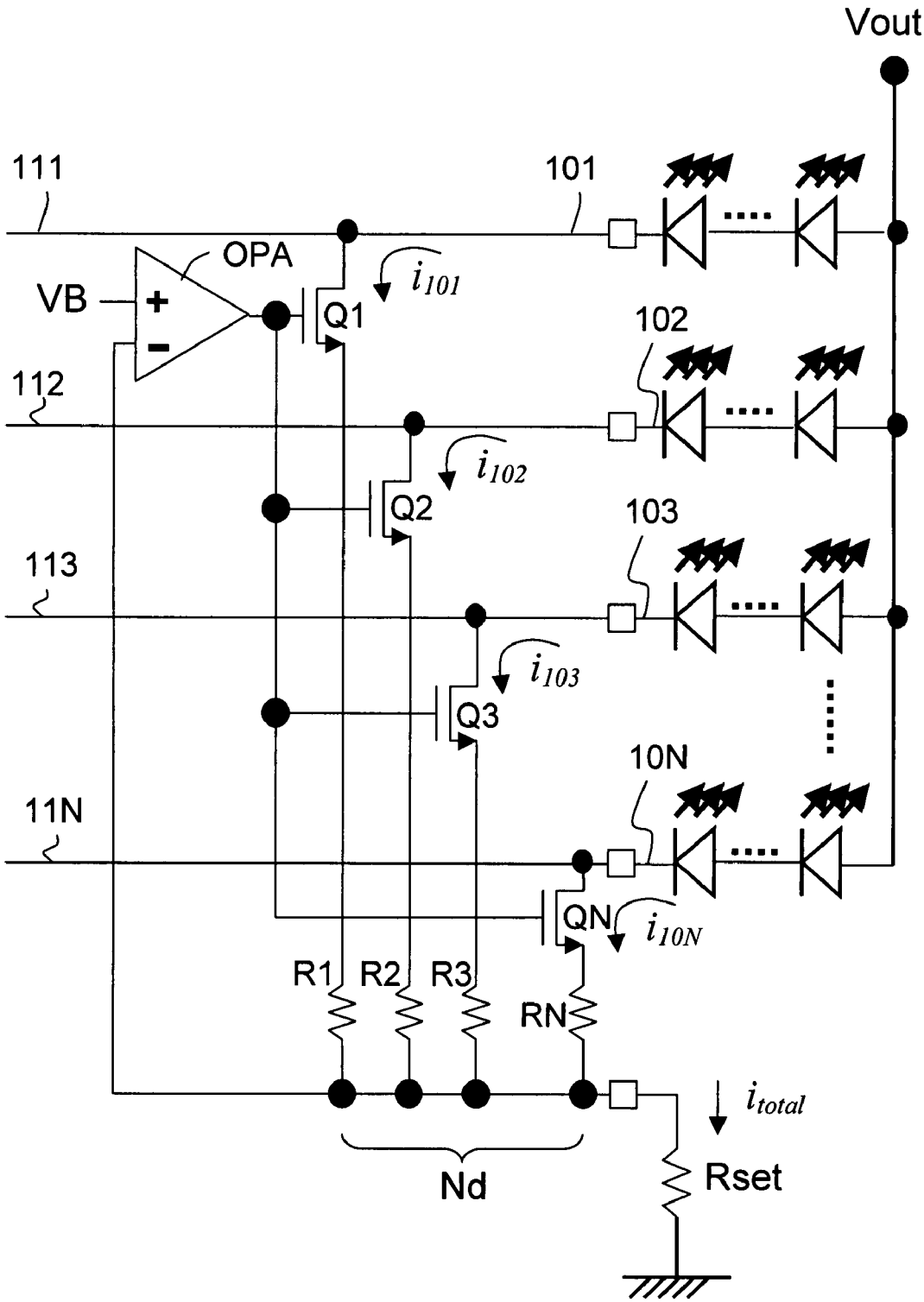
FIGS. 7A-7C show, by way of example, how to embody the circuit of FIG. 6 according to different current matching circuits.

The function of the common resistor Rset can be understood more clearly from FIG. 7A and the following description. The current matching circuits are made of field effect transistors in FIG. 7A. As shown in the figure, the current matching circuit CM1 includes a common operative amplifier OPA, a transistor Q1, and a resistor R1; the current matching circuit CM2 includes the common operative amplifier OPA, a transistor Q2, and a resistor R2; and so on. The resistors R1-RN of the current matching circuits are all connected to the common node Nd, and the common node Nd is connected to the common resistor Rset. By virtue of the operative amplifier OPA, the voltage at the node Nd will be balanced at the level of the reference voltage VB, and thus the current $i_{total}$ passing through the common resistor Rset will be kept at a constant (=VB/Rset).

For convenience, let us assume the currents flowing to the paths 111-11N are ignorable. Thus, the current $i_{total}$ flowing through the common resistor Rset is the total of currents flowing through all of the LED paths 101-10N, that is, $$i_{total}=i_{101}+i_{102}+i_{103}+\ldots+i_{10N}$$

and in the case where the LEDs are operating under the maximum brightness, the brightness of each LED is proportional to the current amount on each of the paths 101-10N.

When anyone or more of the paths 101-10N are inoperative, for example when the path 101 is open, $i_{101}$ becomes zero, so $$i_{total}=i_{102}+i_{103}+\ldots+i_{10N}$$

However, the total current $i_{total}$ is a constant (=VB/Rset), so the currents on the other paths 102-10N increase, and the brightness of the LEDs in the paths 102-10N correspondingly increase to compensate the lost brightness of the LEDs in the path 101. The overall brightness is thus compensated.

Preferably, the currents $i_{101}$-$i_{10N}$ on the paths 101-10N are equal to each other, but the LEDs and the resistors R1-RN may be different from one another due to manufacture deviations, causing deviations of the currents $i_{101}$-$i_{10N}$; this does not affect the effect of the present invention, however.

Figure 7B:
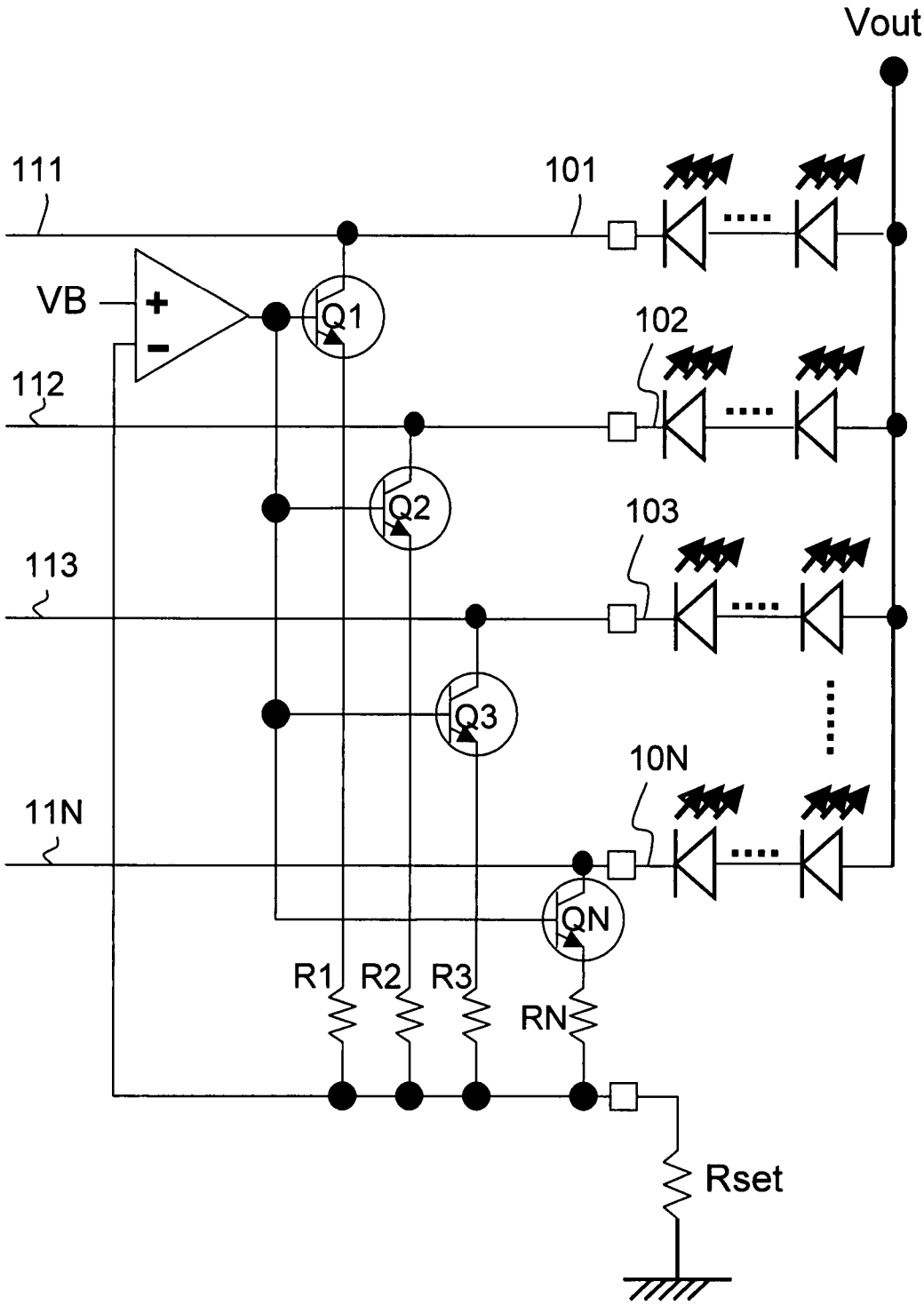

The current matching circuits can be made of bipolar transistors, as shown in FIG. 7B. The circuit functions in a similar way to that in FIG. 7A; the details of its operation are not redundantly repeated here.

Figure 7C:
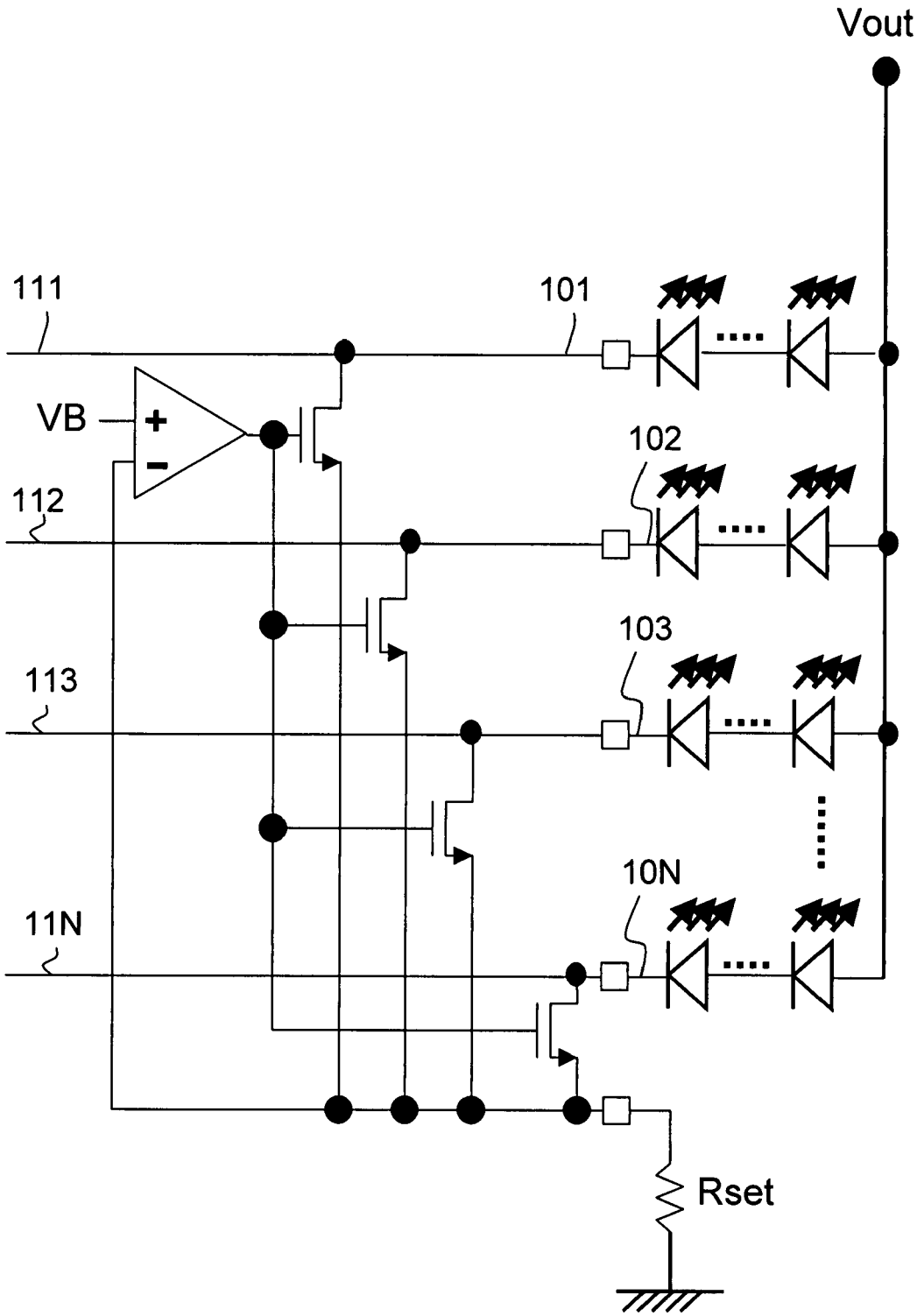

In fact, the resistors R1-RN in the current matching circuits CM1-CMN are not absolutely necessary. As shown in FIG. 7C, these resistors R1-RN can be omitted, and the current matching among the paths can be achieved by layout and matching design of the transistors in the current matching circuits CM1-CMN.

Figure 8:
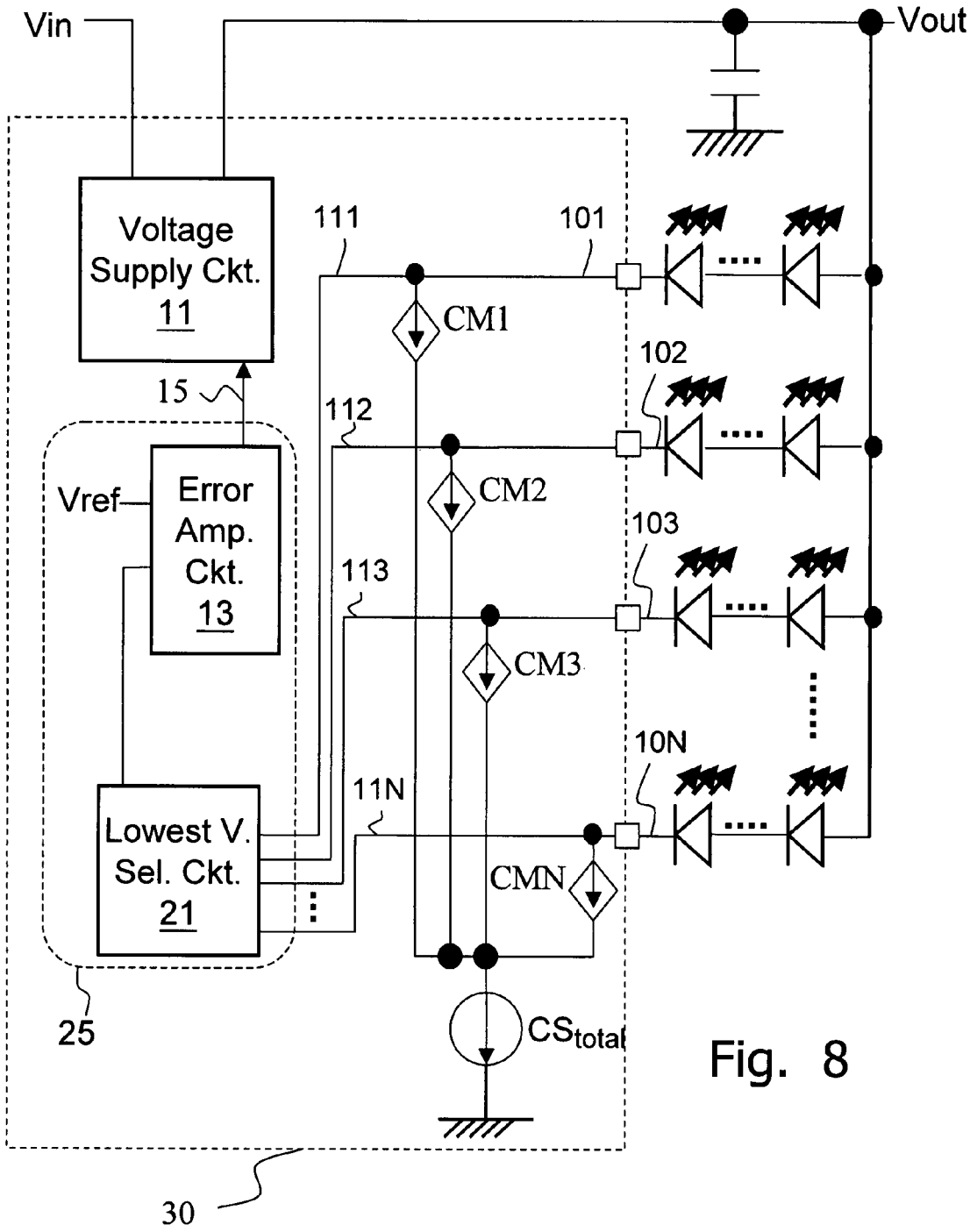
FIG. 8 is a schematic circuit diagram showing a backlight control circuit according to another embodiment of the present invention.
Figure 9:
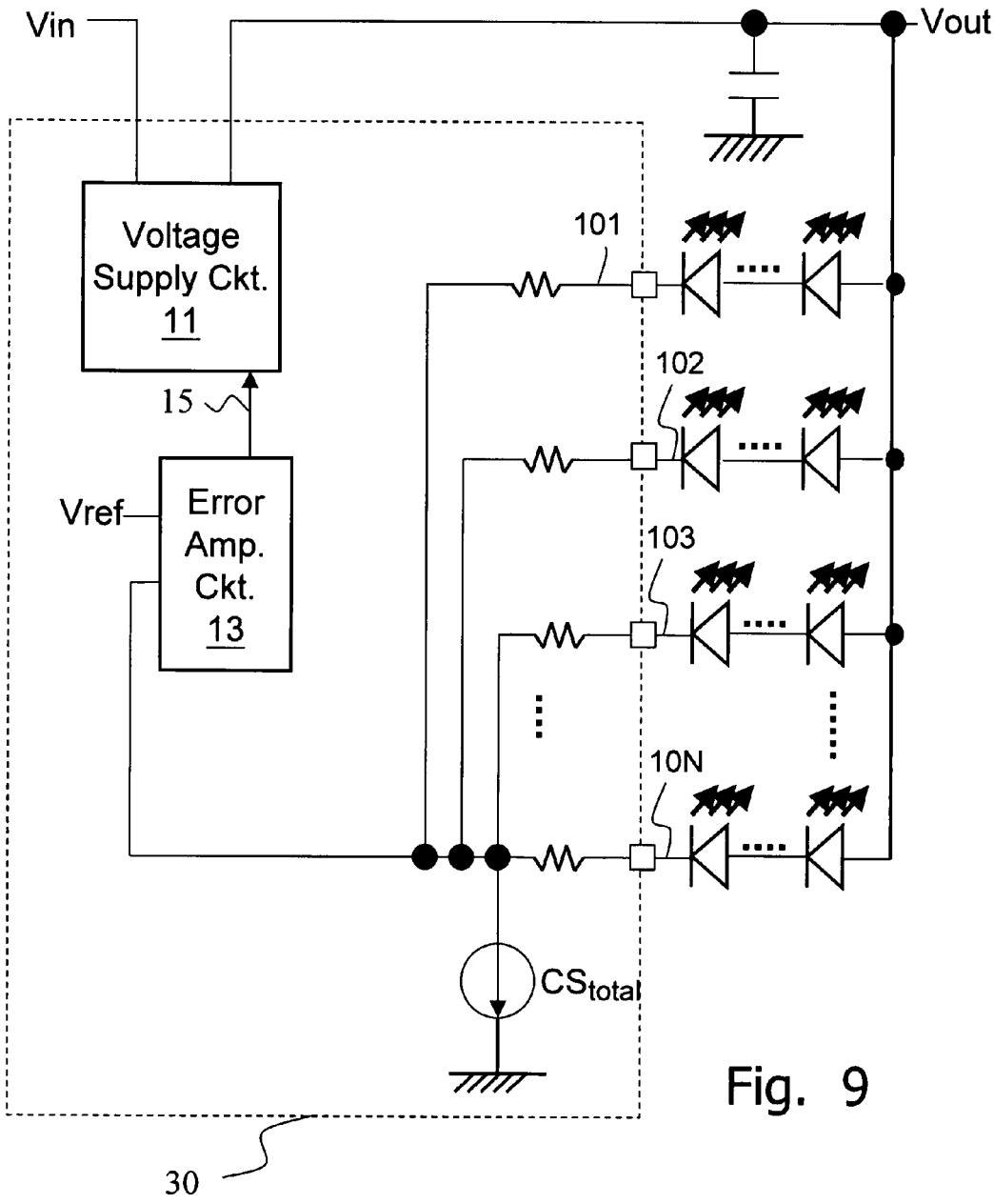
FIG. 9 is a schematic circuit diagram showing a backlight control circuit according to a further embodiment of the present invention.
Figure 10:
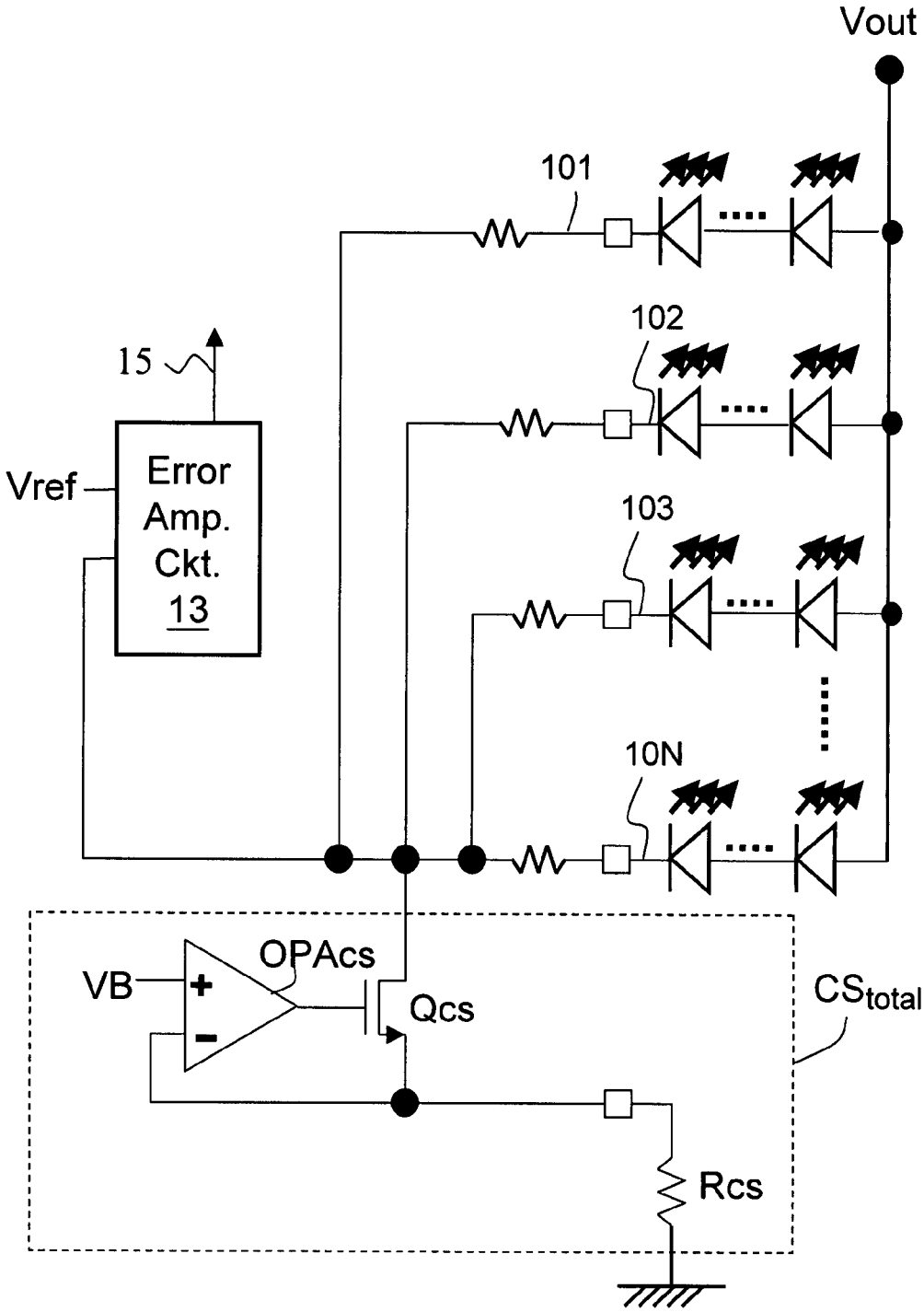
FIG. 10 illustrates more details of the circuit of FIG. 9.

The common resistor Rset in the foregoing embodiments is provided for setting and adjusting the current $i_{total}$ from outside of the circuit. For the basic spirit "to automatically compensate the overall brightness", it is sufficient as long as the current $i_{total}$ is set to be a constant. Hence, the total current setting circuit 35 does not have to be a common resistor Rset, but instead can be any other device. For example, as shown in FIG. 8, the total current can be controlled by a total control current source $CS_{total}$. Furthermore, as shown in FIG. 9, the current matching circuits CM1-CMN can be replaced by corresponding resistors in the LED paths 101-10N, for rough current matching. In this embodiment the currents on the LED paths 101-10N are not precisely equal to one another, but the circuit structure is simpler. FIG. 10 shows a more detailed structure of the circuit of FIG. 9, in which the total control current source $CS_{total}$ is composed of a transistor Qcs, an operative amplifier OPAcs, and a resistor Rcs. If it is desired to set and adjust the total current from outside of the circuit, the resistor Rcs can be located at the outside of the integrated circuit (thus the total control current source $CS_{total}$ is partially located outside of the integrated circuit). The transistor Qcs is shown as a field effect transistor, but can be replaced by a bipolar transistor.

From the above description, it can be seen that the idea of the present invention is to set the total current $i_{total}$ to be a constant. All equivalent ways achieving such effect should belong to the scope of the present invention.

In the present invention, when one of the LED paths is inoperative, the brightness of the LEDs in the other LED paths increases to compensate the lost brightness. Hence, the original brightness of each LED should not be set to the maximum brightness. The original brightness of each LED can be set as (N−1)/N, (N−2)/N, . . . , or (N−M)/N of the maximum brightness, wherein N is the number of original LED paths, $1 \leqq M \leqq (N-1)$, and M is a positive integer.

Figure 11:
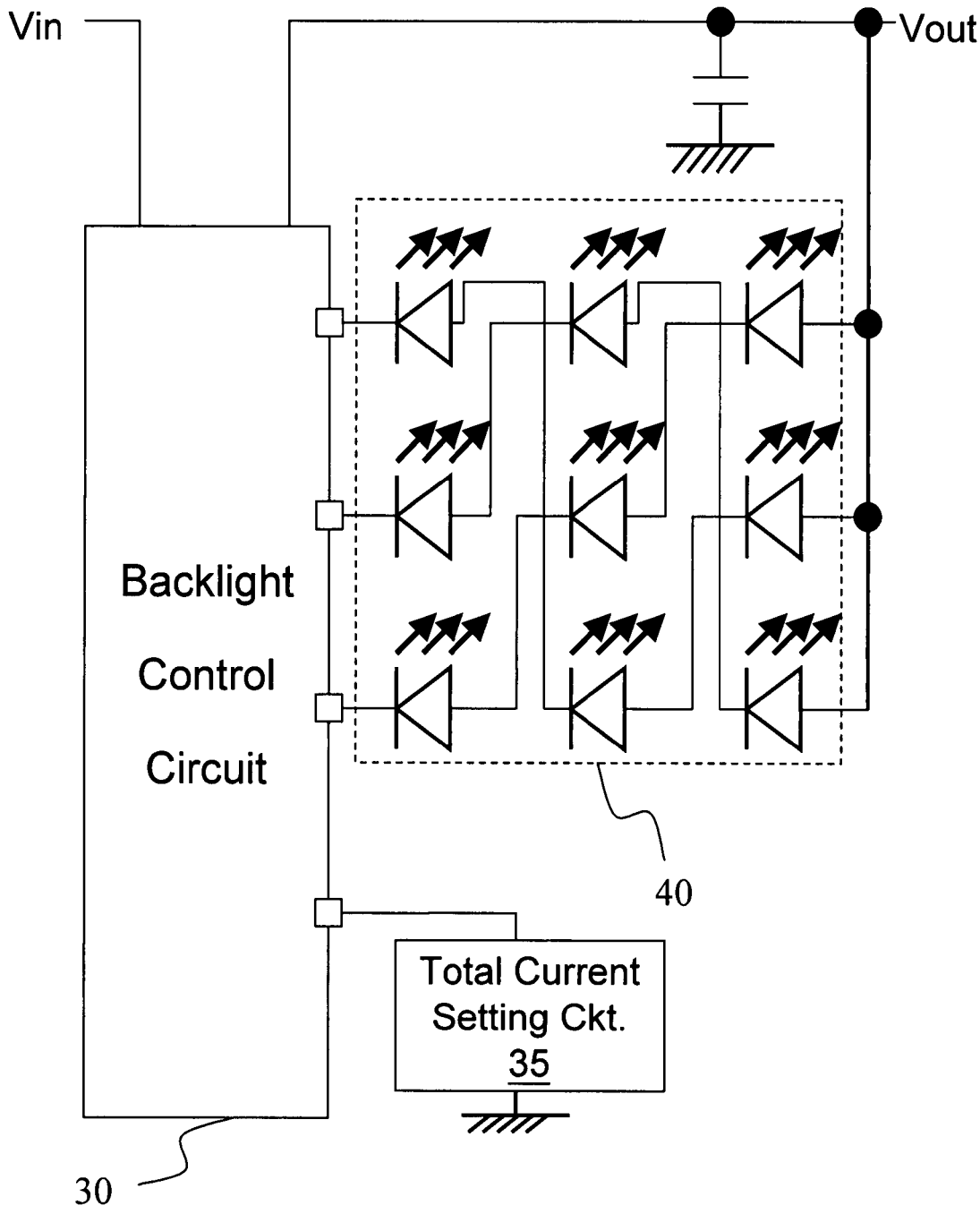
FIG. 11 shows an arrangement wherein neighboring LEDs are allocated to different paths to balance brightness.

Furthermore, as shown in FIG. 11, to avoid perceivable darkness on the LCD screen when one of the LED paths is inoperative, the LED array 40 is preferably arranged in such a manner that the neighboring LEDs are allocated to different LED paths. Thus, when one of the LED paths is inoperative, the overall brightness of the screen is kept uniform. FIG. 11 only shows one among many possible arrangements to this end, and there are numerous variations to allocate the LEDs under the same spirit. And as stated above, the total current setting circuit 35 needs not be located outside of the integrated circuit.

Figure 12:
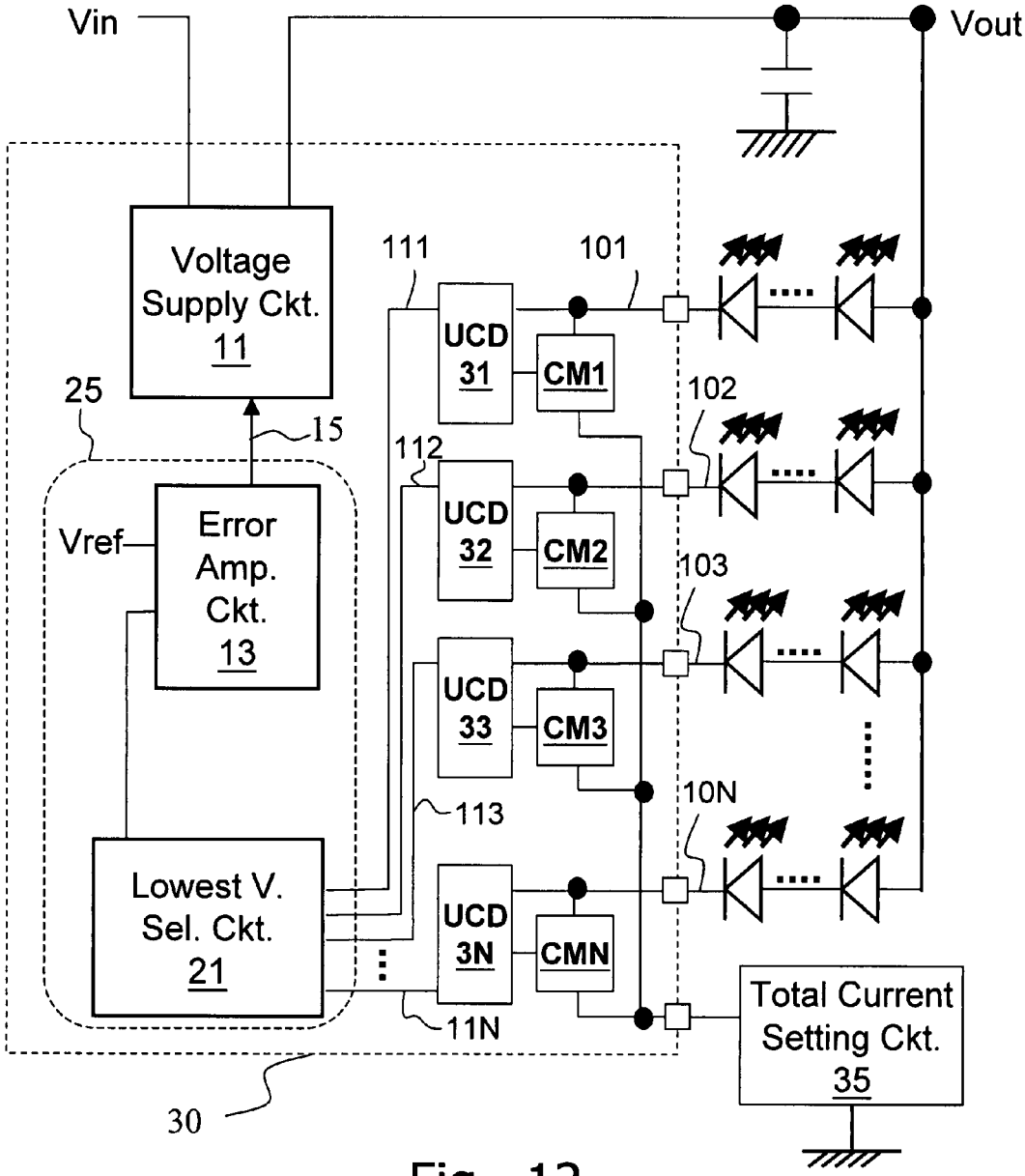
FIG. 12 is a schematic circuit diagram showing a backlight control circuit according to yet another embodiment of the present invention, which includes under current detection circuits.

Moreover, as shown in FIG. 12, the backlight control circuit 30 can further comprise under current detection (UCD) circuits 31-3N. The UCD circuits 31-3N detect the current conditions on the LED paths 101-10N to determine whether an under current condition, i.e., a "no current" or "very low current" condition, occurs in any of the paths. When "no current" or "very low current" condition does not occur, the voltage signals on the LED paths 101-10N pass through the UCD circuits 31-3N to the corresponding voltage comparison paths 111-11N, so that the lowest voltage comparison and amplifier circuit 21 receives those signals. When anyone or more LED paths 101-10N have no current or very low current, the UCD circuits 31-3N exclude the corresponding one or more voltage comparison paths 111-11N so that they are not valid inputs to the lowest voltage comparison and amplifier circuit 21, that is, the lowest voltage comparison and amplifier circuit 21 does not accept signals on these invalid voltage comparison paths 111-11N.

By means of the UCD circuits 31-3N, if anyone of the LED paths 101-10N is open or floating, the corresponding UCD circuits 31-3N will cut off the corresponding paths 111-11N. For example, if the LED path 101 is open, because the path 111 is cut off, the lowest voltage selection circuit 21 will select the one with the lowest voltage only from the paths 112-11N and input the selected one to the error amplifier circuit 13. Although the LEDs in the path 101 can not function, the voltage supply circuit 11 can still supply proper voltage to the rest of the operating LEDs; the voltage supply circuit 11 will not increase the output voltage Vout unlimitedly to burn out the circuit. Furthermore, when the number of pins to be connected with LED paths is more than required, the excess pins can be simply floating or grounded; such arrangement does not consume power, nor do the devices connected with the pins have to be high voltage devices.

In addition, if it is desired to ensure proper initialization of the backlight control circuit 30, a start-up circuit or a logic circuit may be provided in the backlight control circuit 30.

For details of the UCD circuits, start-up circuit or logic circuit, please refer to the co-pending patent application filed by the same assignee under the same title, on the same filing date.

Figure 13A:
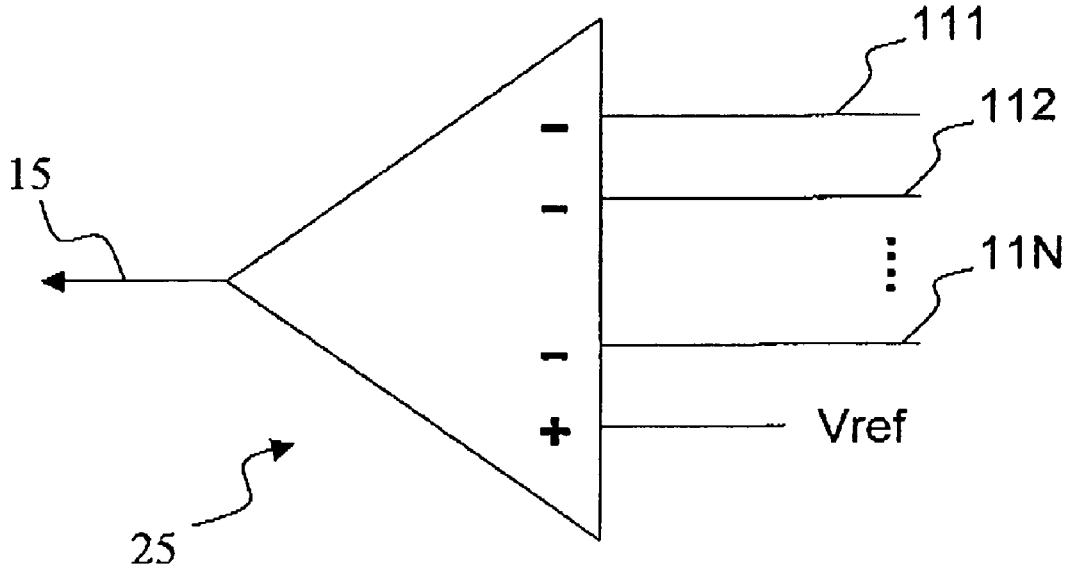
FIG. 13A is a schematic circuit diagram showing a lowest voltage comparison and amplifier circuit.
Figure 13B:
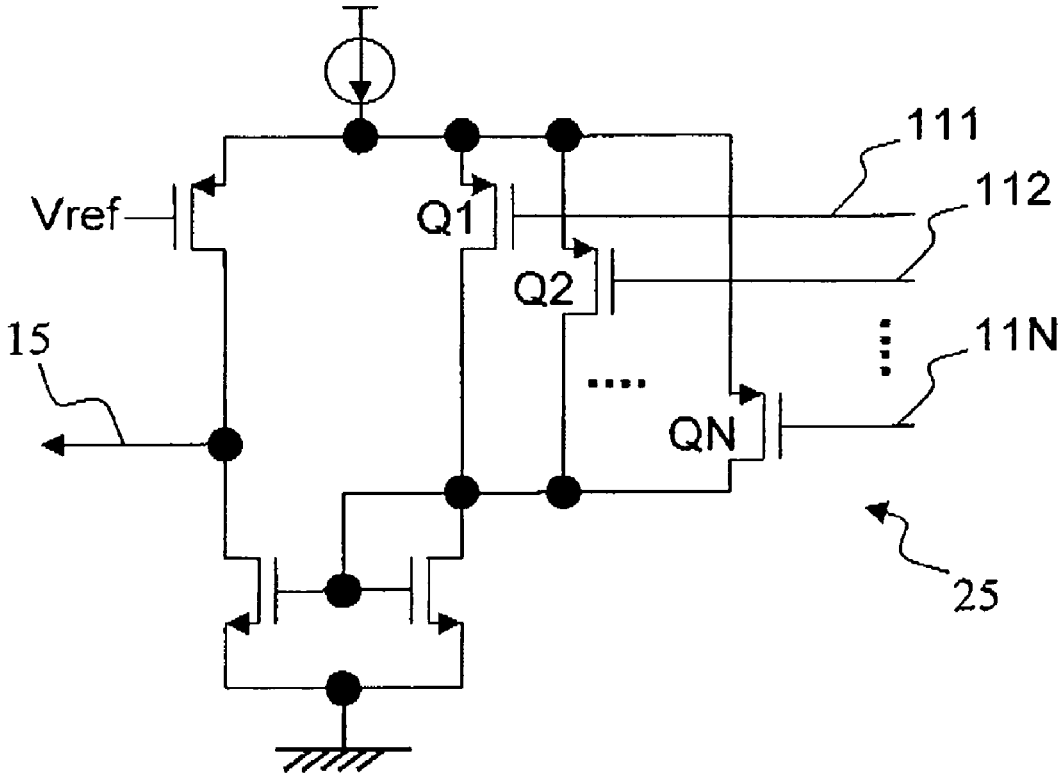
FIGS. 13B and 13C show two embodiments of the lowest voltage comparison and amplifier circuit.
Figure 13C:
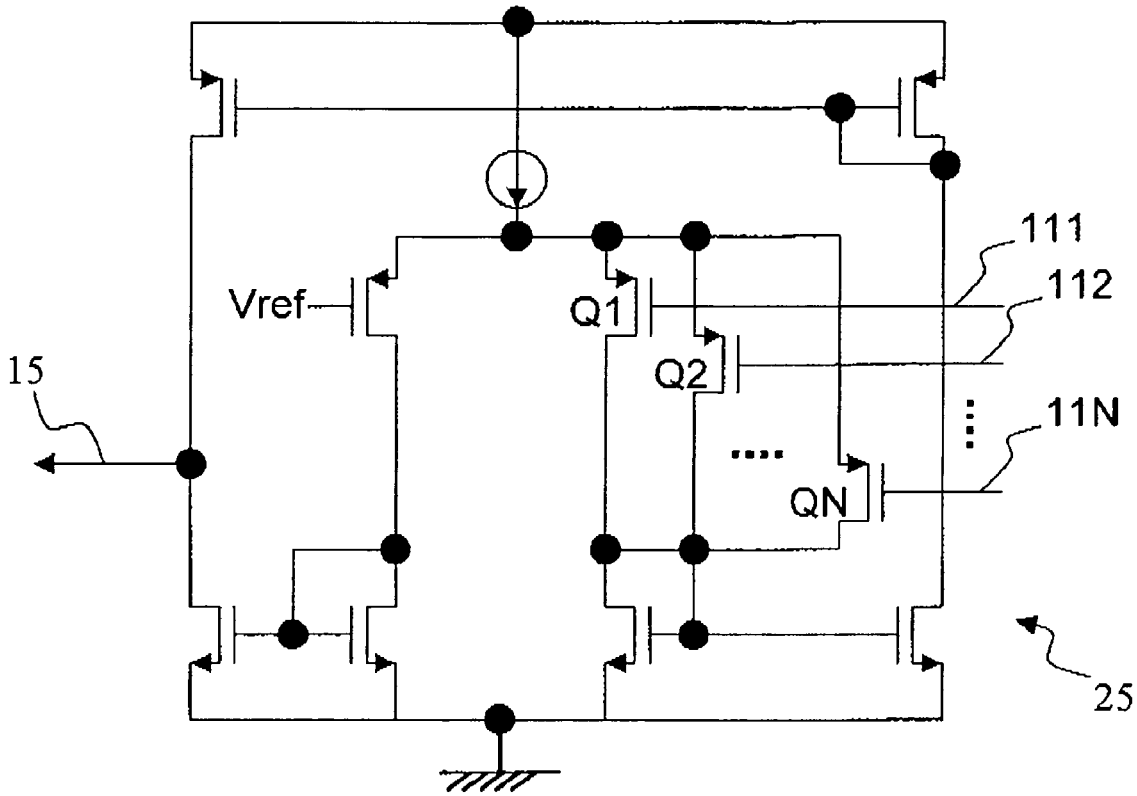

Practically, in one embodiment, the lowest voltage selection circuit 21 in FIGS. 5, 6, 8 and 12 can be integrated with the error amplifier 13 to become one "lowest voltage comparison and amplifier circuit" 25, as shown in FIG. 13A. Two examples of such lowest voltage comparison and amplifier circuit 25 are shown in FIG. 13B (wherein only the input stage is shown; the circuit can be connected with another circuit stage to amplify the output) and FIG. 13C. The lowest voltage comparison and amplifier circuit 25 can be made of devices other than MOSFETs, such as of bipolar transistors or junction FETs. It is also doable to separate the error amplifier 13 from the lowest voltage comparison and amplifier circuit 25. All such variations should belong to the scope of the present invention.

Figure 14A:
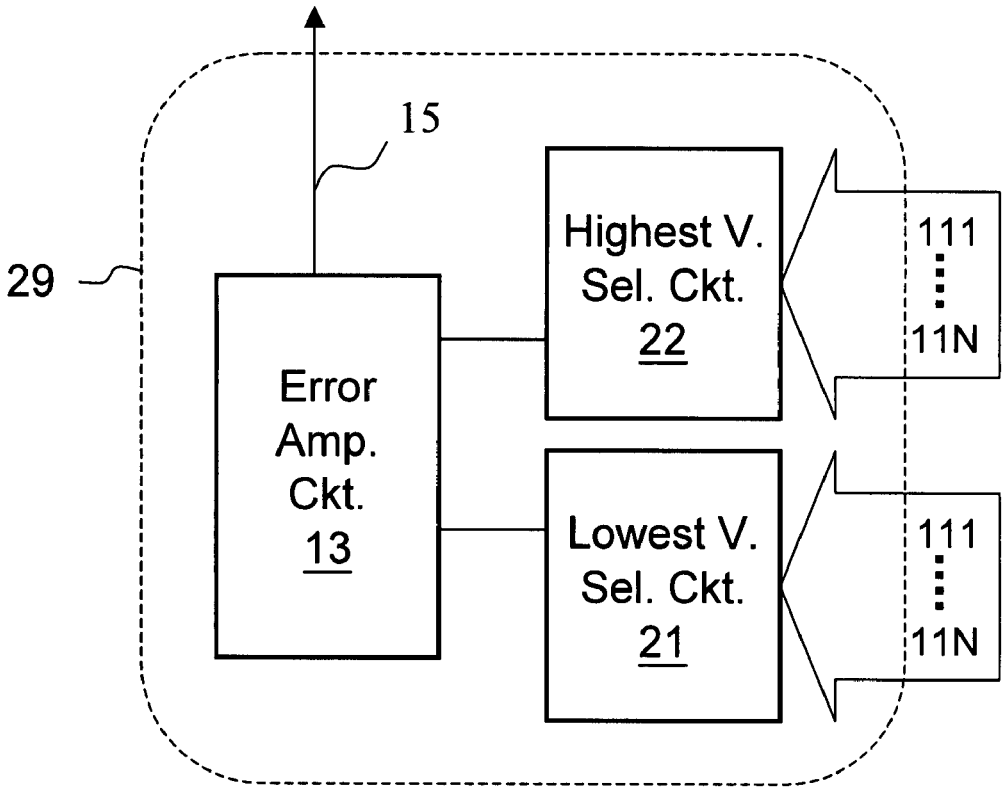
FIGS. 14A and 14B show two embodiments of the voltage selection, comparison and amplifier circuit.
Figure 14B:
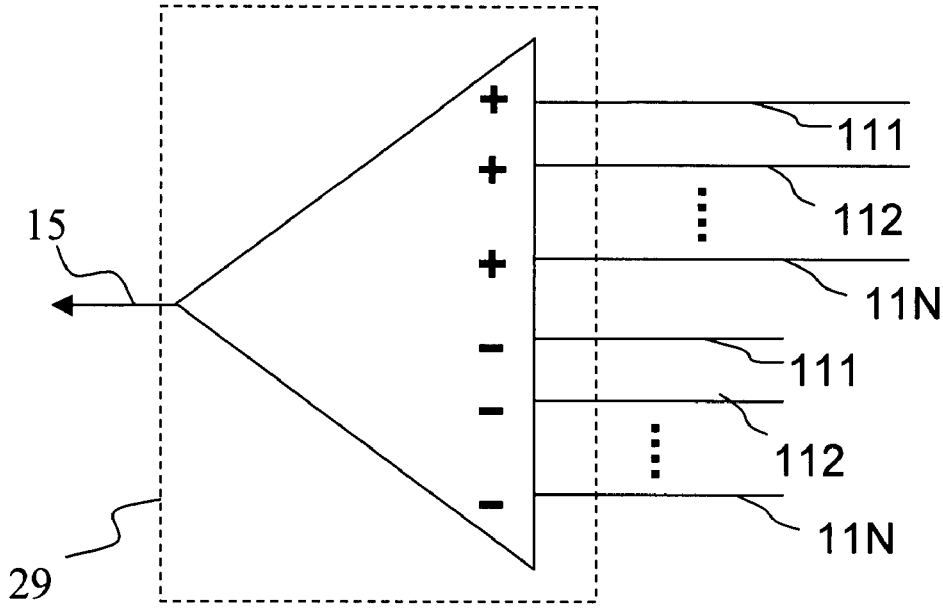

In addition to the above, the reference voltage Vref of the lowest voltage comparison and amplifier circuit 25 does not have to be a constant, but instead can be a variable; the variable reference voltage Vref is preferably a function of the voltages extracted from the paths 101-10N. For example, as shown in FIGS. 14A and 14B wherein the lowest voltage comparison and amplifier circuit 25 is replaced by a high-low voltage comparison and amplifier circuit 29. In the high-low voltage comparison and amplifier circuit 29, the other input of the error amplifier 13 is the output of the highest voltage selection circuit 22 instead of the reference voltage Vref; the control signal 15 is generated according to the comparison result between the highest voltage and the lowest voltage. For details of the high-low voltage comparison and amplifier circuit, please refer to another co-pending patent application filed by the same assignee on the same filing date, also titled "backlight control circuit".

Although the present invention has been described in considerable detail with reference to certain preferred embodiments, these embodiments are for illustrative purpose and not for limiting the scope of the present invention. Other variations and modifications are possible. For example, in all of the embodiments, one can insert a circuit which does not affect the primary function, such as a delay circuit, between any two devices which are shown to be directly connected. In the embodiments, all the current matching circuits are connected to one common node Nd, but it can be arranged such that only some of the current matching circuits are connected to one common node, or, several common nodes and several common resistors are provided and the current matching circuits are grouped and each group of current matching circuits are connected to one of the nodes. The backlight control circuit 30 is shown to be one integrated circuit, but it can be divided into several integrated circuits, or integrated with other circuit functions. The present invention is not only applicable to series-parallel connection circuits, but also to all-in-parallel circuits. The light emitting device, although shown as LED in the above, are not limited thereto but can be other light emitting devices such as an organic light emitting diode. And the word "backlight" in the term "backlight control circuit" is not to be taken in a narrow sense that the circuit has to control the backlight of a screen; the present invention can be applied to "active light emission display", or "LED illuminator", or other apparatuses that employ light emitting devices. Therefore, all modifications and variations based on the spirit of the present invention should be interpreted to fall within the scope of the following claims and their equivalents.

What is claimed is:

1. A backlight control circuit, comprising:

a plurality of current matching circuits respectively controlling currents on corresponding plurality of light emission device paths; and a common node electrically connected with the plurality of current matching circuits, for electrically connecting with a total current setting circuit, wherein each of the plurality of current matching circuits includes a transistor, and one and the same operative amplifier is shared among the plurality of current matching circuits, the operative amplifier comparing a voltage at the common node with a reference voltage to generate an output controlling the transistor in each of the plurality of current matching circuits; and wherein when any light emission device is inoperative, the brightness of other operative light emission devices is passively increased to compensate the brightness lost by the inoperative light emission device.

2. The backlight control circuit of claim 1, wherein: the backlight control circuit is an integrated circuit, and the total current setting circuit is completely or partially located outside of the integrated circuit; the integrated circuit includes a pin for electrically connecting with the total current setting circuit or the part of the total current setting circuit located outside of the integrated circuit.

3. The backlight control circuit of claim 1, wherein the backlight control circuit is an integrated circuit including the total current setting circuit located inside of the integrated circuit.

4. The backlight control circuit of claim 1, wherein the total current setting circuit is a common resistor having one end electrically connected with the common node.

5. The backlight control circuit of claim 1, wherein the transistor is a field effect transistor and each of the plurality of current matching circuits further includes a resistor connected in series between the field effect transistor and the common node.

6. The backlight control circuit of claim 1, wherein the transistor is a bipolar transistor and each of the plurality of current matching circuits further includes a resistor connected in series between the bipolar transistor and the common node.

7. The backlight control circuit of claim 1, wherein the plurality of light emission device paths include light emission devices having default brightness lower than a maximum brightness, when no light emission device is inoperative.

8. The backlight control circuit of claim 1, wherein the number of the current matching circuits is N, N being an integer larger than or equal to 2, and wherein the plurality of light emission device paths include light emission devices having brightness set to be (N−M)/N of a maximum brightness when no light emission device is inoperative, wherein $1 \leqq M \leqq (N-1)$, being a positive integer, such that when any light emission device is inoperative, the brightness of other operative light emission devices is increased to compensate the brightness lost by the inoperative light emission device.

9. The backlight control circuit of claim 1, wherein the plurality of light emission device paths include light emission devices wherein at least three of the light emission devices form an array, and in the array every two non-diagonal neighboring light emission devices belong to two different light emission device paths.

10. The backlight control circuit of claim 1, further comprising at least one under current detection circuit electrically connected with at least one corresponding light emission device path, for detecting an under current condition in the corresponding light emission device path.

11. The backlight control circuit of claim 1, wherein a pin is provided in each of the light emission device paths.

12. The backlight control circuit of claim 11, wherein at least one pin is floating or grounded without connecting to a light emission device.

13. A backlight control circuit, comprising:

a plurality of light emission device paths; and a common node electrically connected with the plurality of light emission device paths, and also electrically connected with a total control current source, the total control current source controlling a total current on the plurality of light emission device paths, wherein the plurality of light emission device paths include light emission devices wherein at least three of the light emission devices form an array, and in the array every two non-diagonal neighboring light emission devices belong to two different light emission device paths, and when any light emission device is inoperative, the brightness of other operative light emission devices is passively increased to compensate the brightness lost by the inoperative light emission devices.

14. The backlight control circuit of claim 13, wherein the backlight control circuit is an integrated circuit, and the total control current source includes a resistor located outside of the integrated circuit.

15. The backlight control circuit of claim 13, wherein the plurality of light emission device paths include light emission devices having default brightness lower than a maximum brightness, when no light emission device is inoperative, such that when any light emission device is inoperative, the brightness of other operative light emission devices is increased to compensate the brightness lost by the inoperative light emission device.

16. A method for controlling light emission devices, comprising:

(A) providing a plurality of light emission device paths connected in parallel;

(B) setting a total current of the paths connected in parallel to a constant; and (C) providing a current matching circuit for each, of the plurality of light emission device paths, wherein the current matching circuits share a common operative amplifier which compares a voltage at a common node with a reference voltage such that currents in the current matching circuits match with one another when a total current is set to a constant, and when any light emission device is inoperative, the brightness of other operative light emission devices is passively increased to compensate the brightness lost by the inoperative light emission device.

17. The method of claim 16, further comprising: (D) respectively controlling the currents on the plurality of light emission device paths.

18. The method of claim 16, wherein the current matching circuits share a common resistor.

19. The method of claim 16, wherein the step (B) includes: providing a common resistor connected in series with the plurality of light emission device paths connected in parallel.

20. The method of claim 19, wherein a voltage across the common resistor is set to be a constant.

21. The method of claim 16, further comprising: (D1) providing light emission devices in the plurality of light emission device paths; and (D2) setting the default brightness of each light emission device to be lower than a maximum brightness when no light emission device is inoperative, such that when any light emission device is inoperative, the brightness of other operative light emission devices is increased to compensate the brightness lost by the inoperative light emission device.

22. The method of claim 16, further comprising: (D1) providing light emission devices in the plurality of light emission device paths; (D3) forming an array by at least three of the light emission devices; and (D4) arranging the light emission devices so that every two non-diagonal neighboring light emission devices in the array belong to two different light emission device paths.

23. The method of claim 16, further comprising: (E) detecting whether one of the plurality of light emission device paths is in an under current condition.

* * * * *